US011135467B2

(12) United States Patent
Ferrara

(10) Patent No.: US 11,135,467 B2
(45) Date of Patent: Oct. 5, 2021

(54) COLOR-BANDED WEIGHTLIFTING BAR

(71) Applicant: Kenneth D. Ferrara, Rusk, TX (US)

(72) Inventor: Kenneth D. Ferrara, Rusk, TX (US)

( * ) Notice: Subject to any disclaimer, the term of this patent is extended or adjusted under 35 U.S.C. 154(b) by 0 days.

(21) Appl. No.: 16/148,801

(22) Filed: Oct. 1, 2018

(65) Prior Publication Data

US 2019/0336811 A1 Nov. 7, 2019

Related U.S. Application Data

(60) Provisional application No. 62/671,256, filed on May 14, 2018, provisional application No. 62/665,904, filed on May 2, 2018.

(51) Int. Cl.
*A63B 21/072* (2006.01)
*A63B 71/06* (2006.01)

(52) U.S. Cl.
CPC .. *A63B 21/0724* (2013.01); *A63B 2071/0602* (2013.01); *A63B 2071/0694* (2013.01); *A63B 2244/09* (2013.01)

(58) Field of Classification Search
CPC ..... A63B 21/072–075; A63B 2071/0694
See application file for complete search history.

(56) References Cited

U.S. PATENT DOCUMENTS

| | | | | |
|---|---|---|---|---|
| 5,135,455 | A * | 8/1992 | King | A63B 21/0726 482/105 |
| 5,328,431 | A | 7/1994 | Winslow | |
| 6,723,006 | B1 * | 4/2004 | Lin | A63B 60/14 473/300 |
| 7,491,155 | B2 | 2/2009 | Fenelon et al. | |
| 10,188,895 | B1 * | 1/2019 | Wallace | A63B 21/0726 |
| 2009/0298654 | A1 * | 12/2009 | Dickerson | A63B 21/075 482/93 |
| 2014/0221173 | A1 * | 8/2014 | Crabtree | A63B 21/023 482/106 |
| 2017/0056703 | A1 * | 3/2017 | Phelps | A63B 21/075 |
| 2017/0189735 | A1 | 7/2017 | Buikema | |

* cited by examiner

*Primary Examiner* — Jennifer Robertson
(74) *Attorney, Agent, or Firm* — Kirby Drake

(57) ABSTRACT

A weightlifting bar and a weight equipment system may provide grooves and/or spaces that may provide a color. The placement of the grooves and/or spaces may prevent users from improperly utilizing the weightlifting bar and weight equipment system when lifting the bar. The weightlifting bar and weight equipment system may also prevent injury to users by providing guidelines to ensure symmetry of user hands and/or fingers along the weightlifting bar.

13 Claims, 1 Drawing Sheet

COLOR-BANDED WEIGHTLIFTING BAR

CROSS-REFERENCE TO RELATED APPLICATIONS

The present application hereby claims priority to Provisional Patent Application No. 62/671,256, filed on May 14, 2018, entitled "COLOR-BANDED WEIGHTLIFTING BAR," and Provisional Patent Application No. 62/665,904, filed on May 2, 2018, entitled "COLOR-BANDED WEIGHTLIFTING BAR," both of which are incorporated herein by reference in their entirety.

TECHNICAL FIELD

The disclosure relates generally to weightlifting bars. In particular, the disclosure relates to a color-banded weightlifting bar.

BACKGROUND

Traditional weightlifting bars typically fail to provide obvious indicators for placement of user hands and/or fingers. Users can struggle or fail to achieve symmetry of user hands and/or fingers along the weightlifting bar. A lack of symmetry or equilibrium can cause injury and may not provide equal muscle growth benefits to both sides of the body of the user.

SUMMARY

Embodiments of the present disclosure generally provide a weightlifting bar. The weightlifting bar may include a plurality of grooves or spaces, and each of the plurality of grooves or spaces may be shaped to receive user hands or fingers. A plurality of bands may be provided in each of the plurality of grooves or spaces, and each of the plurality of bands may provide a different color. Each of the plurality of grooves or spaces may be provided in groups of two an equal distance away from a center point of the weightlifting bar. The weightlifting bar may provide one or more handles that may provide color-coordinated indicators that may be based on weight. The plurality of grooves or spaces may be configured to equalize the user hands or fingers an equal distance from a center point of the weightlifting bar. The plurality of grooves or spaces may be configured to provide a comfort grip and may prevent user injury. The plurality of bands may be removable and replaceable. The weightlifting bar may be in the form of a barbell that may include the plurality of grooves or spaces. The weightlifting bar may be in the form of a curling bar that may include the plurality of grooves or spaces.

Embodiments of the present disclosure generally provide a weight equipment system. The weight equipment system may include a weightlifting bar that may provide a plurality of grooves or spaces. The weight equipment system may include a plurality of bands that may be provided in each of the plurality of grooves or spaces. Each of the plurality of bands may provide a different color, and user hands or fingers may fit in each of the plurality of grooves or spaces. Each of the plurality of grooves or spaces may be provided in groups of two an equal distance away from a center point of the weightlifting bar. One or more handles may provide color-coordinated indicators, and the plurality of grooves or spaces may be configured to align a user grip along the weightlifting bar. The plurality of grooves or spaces may be configured to prevent user injury. The plurality of bands may be removable and may be replaceable. The weightlifting bar may be in the form of a barbell that may include the plurality of grooves or spaces. The weightlifting bar may be in the form of a curling bar that may include the plurality of grooves or spaces. The plurality of grooves or spaces may be pre-formed in the weightlifting bar.

Other technical features may be readily apparent to one skilled in the art from the following drawings, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

The present disclosure generally provides weightlifting bar that may provide grooves and/or spaces that may have a color that may indicate where user hands and/or fingers may be placed.

Figure 1:
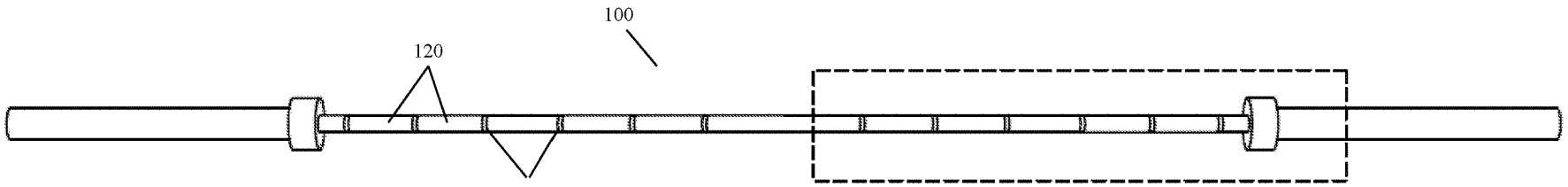
FIG. 1 is a view of a weightlifting bar according to an embodiment of the present disclosure.
Figure 2:
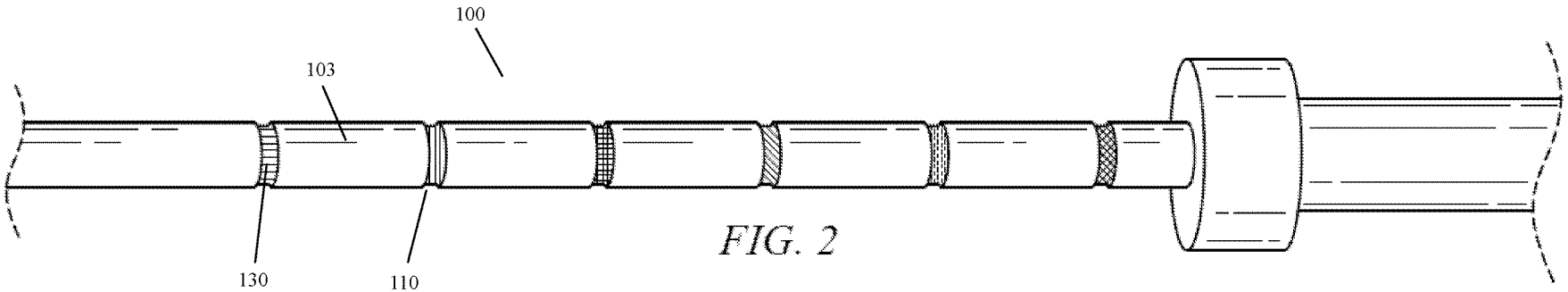
FIG. 2 is a close-up of one side of the weightlifting bar according to FIG. 1 according to an embodiment of the present disclosure.

FIGS. 1 and 2 depict weightlifting bar 100 or a weight equipment system that may provide a plurality of colored grooves and/or spaces 110. Each groove and/or space 110 may provide a color that may correspond to a position of hands and/or fingers of a user. Bands 130 (FIG. 2) may be provided in each groove and/or space 110 of weightlifting bar 100 and may be fixed or removable from groove and/or space 110 without departing from the present disclosure. It should be further be appreciated that bands 130 may provide a gripping mechanism for hands and/or fingers of a user to improve gripping and handling of weightlifting bar 100 in some embodiments of the present disclosure. It should also be appreciated that groove and/or space 110 may be any form of indentation, slot, space, and the like in weightlifting bar 100.

Groove and/or space 110 may be spaced along weightlifting bar 100 in increments of approximately every four inches. It should be appreciated that groove and/or space 110 may be spaced along the circumference of weightlifting bar 100 in increments of more or less than approximately every four inches without departing from the present disclosure. It should be appreciated that groove and/or space 110 may be provided along an entire length of weightlifting bar 100, on each end of weightlifting bar 100, and/or on each end and the center of weightlifting bar 100 in embodiments of the present disclosure. A center point of weightlifting bar 100 may be marked or designated with a color.

In some embodiments of the present disclosure, groove and/or space 110 may be arranged in groups of two an equal distance away from a center point of weightlifting bar 100. It should be appreciated that the center point may provide a color that may allow the center of weightlifting bar 100 to be obvious or noticeable to users. Accordingly, in such a configuration, bands having a first color may be arranged on a first end of weightlifting bar 100, and the first color may be arranged on a second end of weightlifting bar 100 at an equal distance from a center point of weightlifting bar 100 as the first color is provided on the first end. For example, a yellow band may be arranged approximately four inches from a center of weightlifting bar 100 to the right and the left of the center point or at a first end and a second end. A blue band may be arranged approximately four inches from the yellow band at first and second ends of weightlifting bar 100 or approximately eight inches from the center point at first and second ends of weightlifting bar 100. Again, these dimensions may change depending on various factors including, but not limited to, the length or size of weightlifting bar 100 or the number of grooves and/or spaces 110 that may be provided in embodiments of the present disclosure.

It should be appreciated that any quantity of bands 130 may be provided in groove and/or space 110 in embodiments of the present disclosure. It should be appreciated that regardless of distance, there may be symmetry of groove and/or space 110 and bands 130. It should further be appreciated that groove and/or space 110 and bands 130 may be applied to a curling bar, barbell, and any other weight or exercise equipment systems without departing from the present disclosure. It should be appreciated that weightlifting bar 100 may be marked using heavy-duty rubber bands with color, plastic rings with color, epoxy-painted rings with color, and painted rings with color without departing from the present disclosure.

Weightlifting bar 100 or a weight equipment system may provide a plurality of grooves and/or spaces 110 for a user to place his/her hands and/or fingers. Inclusion of groove and/or space 110 may reduce a time required for the user to achieve equilibrium of the weightlifting bar. Weightlifting bar 100 may include handles 120 that may be color-coordinated in some embodiments of the present disclosure. It should be appreciated that groove and/or space 110 may prevent users from improperly utilizing weightlifting bar 100 or weight equipment system by providing guidelines to ensure symmetry of user hands and/or fingers along weightlifting bar 100. Symmetry and security of user hands and/or fingers along weightlifting bar 100 may prevent injury to users and may provide ease of properly utilizing weightlifting bar 100. It should be appreciated that weightlifting bar 100 may have any size or shape without departing from the present disclosure.

It may be advantageous to set forth definitions of certain words and phrases used in this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A weightlifting bar comprising:

a plurality of grooves or spaces in one or more handles on the weightlifting bar, each of the plurality of grooves or spaces shaped to receive user hands or fingers, wherein each of the plurality of grooves or spaces are provided in groups of two an equal distance away from a center point of the weightlifting bar; and a plurality of bands provided in each of the plurality of grooves or spaces, wherein each of the plurality of bands provides a different color to indicate where the user hands or fingers are to be placed.

2. The weightlifting bar according to claim 1, wherein the plurality of grooves or spaces are configured to equalize the user hands or fingers an equal distance from a center point of the weightlifting bar.

3. The weightlifting bar according to claim 1, wherein the plurality of bands are removable.

4. The weightlifting bar according to claim 1, wherein the plurality of bands are replaceable.

5. The weightlifting bar according to claim 1, wherein the weightlifting bar is in the form of a barbell including the plurality of grooves or spaces.

6. The weightlifting bar according to claim 1, wherein the weightlifting bar is in the form of a curling bar including the plurality of grooves or spaces.

7. A weight equipment system, comprising:

a weightlifting bar that provides a plurality of grooves or spaces in one or more handles on the weightlifting bar, wherein the plurality of grooves or spaces are configured in fixed positions to align a user grip along the weightlifting bar, and wherein each of the plurality of grooves or spaces are provided in groups of two an equal distance away from a center point of the weightlifting bar; and one of a plurality of bands provided in each of the plurality of grooves or spaces, wherein the plurality of bands provide a different color to indicate where user hands or fingers are to be placed, wherein user hands or fingers fit in each of the plurality of grooves or spaces.

8. The weight equipment system according to claim 7, wherein the plurality of grooves or spaces are configured to prevent user injury.

9. The weight equipment system according to claim 7, wherein the plurality of bands are removable.

10. The weight equipment system according to claim 7, wherein the plurality of bands are replaceable.

11. The weight equipment system according to claim 7, wherein the weightlifting bar is in the form of a barbell including the plurality of grooves or spaces.

12. The weight equipment system according to claim 7, wherein the weightlifting bar is the form of a curling bar including the plurality of grooves or spaces.

13. The weight equipment system according to claim 7, wherein the plurality of grooves or spaces are pre-formed in the weightlifting bar.

* * * * *